US005349163A

United States Patent [19]

An

[11] Patent Number: 5,349,163

[45] Date of Patent: Sep. 20, 1994

[54] METHOD OF AUTOMATICALLY COOKING FOOD BY DETECTING THE AMOUNT OF GAS OR SMOKE BEING EXHAUSTED FROM A COOKING DEVICE DURING COOKING

[75] Inventor: Seong-Wan An, Suweon, Rep. of Korea

[73] Assignee: SamSung Electronics Co., Ltd., Suwon, Rep. of Korea

[21] Appl. No.: 913,160

[22] Filed: Jul. 14, 1992

Related U.S. Application Data

[63] Continuation-in-part of Ser. No. 744,927, Aug. 14, 1991, Pat. No. 5,155,339.

[30] Foreign Application Priority Data

Aug. 17, 1990 [KR] Rep. of Korea ..... 90-12692

[51] Int. Cl.[5] ..... H05B 1/02

[52] U.S. Cl. ..... 219/492; 219/497; 219/491; 219/707; 340/589; 99/327; 99/325

[58] Field of Search ..... 219/492, 494, 497, 499, 219/506, 10.55 B; 99/325, 327, 326, 329, DIG. 14, 330; 73/336.5, 73; 340/588, 589

[56] References Cited

U.S. PATENT DOCUMENTS

| | | | |
|---|---|---|---|
| 4,097,707 | 6/1978 | Kobayashi et al. | 219/10.55 B |
| 4,311,895 | 1/1982 | Tanabe | 219/492 |
| 4,316,068 | 2/1982 | Tanabe | 219/492 |
| 4,379,964 | 4/1983 | Kanazawa et al. | 219/492 |
| 4,433,232 | 2/1984 | Tachikawa et al. | 219/10.55 B |
| 4,734,554 | 3/1988 | Tateda et al. | 219/10.55 B |
| 4,839,503 | 6/1989 | Wolf et al. | 219/492 |
| 4,864,088 | 9/1989 | Hiejima et al. | 219/492 |
| 5,155,339 | 10/1992 | An | 219/492 |

*Primary Examiner*—Mark H. Paschall
*Attorney, Agent, or Firm*—Robert E. Bushnell

[57] ABSTRACT

An automatic cooking method for cooking food wherein one of a timed or automatic cooking mode is selected prior starting the heating of the food upon depressing a cooking start key. The quantity or concentration of gas (e.g. carbon dioxide) or smoke emitted from the food every sampling time of a certain period is determined, and counting the time T1 taken for the quantity or concentration of gas or smoke to vary from a predetermined minimum value to a predetermined maximum value is also determined. The cooking is carried out to further heating the food for a time T2 calculated by multiplying the counted heating time T1 by a coefficient predetermined depending on the food.

18 Claims, 4 Drawing Sheets

METHOD OF AUTOMATICALLY COOKING FOOD BY DETECTING THE AMOUNT OF GAS OR SMOKE BEING EXHAUSTED FROM A COOKING DEVICE DURING COOKING

BACKGROUND OF THE INVENTION

This is a continuation-in-part of U.S. application Ser. No. 07/744,927 filed 14 Aug. 1991 now U.S. Pat. No. 5,155,339.

FIELD OF THE INVENTION

The present invention relates to an automatic cooking method wherein automatic cooking is performed by sensing the quantity or concentration of gas (e.g. carbon dioxide) or smoke generated from food during the cooking process, and more particularly, to an automatic cooking method which enables cooking food for a proper period, irrespective of initial temperature of the food to be heated.

INFORMATION DISCLOSURE STATEMENT

Cooking food under the optimum condition is determined by the quantity of food, initial food temperature and the kind of heating means used. Also, the state of food being cooked depends on the period the food is heated at a particular temperature. Accordingly, cooking food under the optimum condition can be accomplished by determining the temperature of the food being cooked and heating the food for a predetermined period from the time that the food temperature reaches a desired level.

There are various methods for measuring the temperature of the food. For example, the food temperature may be indirectly determined by utilizing the relationship between the food temperature and the moisture generated from the food.

U.S. Reissue Pat. No. 10,394 discloses et method for controlling the food cooking period by utilizing the relationship between the food temperature and the humidity caused by the food being cooked.

This patent illustrates an apparatus for regulating the period of heating food by utilizing a humidity sensor. The humidity sensor is positioned in an exhaust duct of the cooker and adapted for sensing the quantity of gas or smoke exhausted from the food being heated. The heating of the food is continued until the generated humidity reaches a predetermined value. The food is further heated for a period which corresponds to the product of the previous heating time by a certain coefficient.

That is, cooking is performed under the condition that the humidity, i.e., the quantity of generated moisture, has been previously predetermined. Food is heated until the humidity sensed by the sensor reaches the predetermined humidity "Hi" as the quantity of moisture generated during the cooking is increased by the amount corresponding to the humidity increment "$\delta V$", over the initial quantity of moisture generated at the moment cooking is initiated. Then, the food is further heated for the period T2, which is calculated by multiplying the previous heating time by a coefficient which is determined according to the kind of the food being cooked and the high-frequency wave output condition of the electronic range used in the cooking.

Even in the case of the same food, however, the time taken to reach the predetermined humidity may vary, depending on the temperature of the food to be cooked or the frozen condition of the prepared materials.

In the conventional cooking method, therefore, there is a problem that even in the same food, it may be overcooked or undercooked, depending on the initial heating condition, since the period from the time at which heating is initiated to the time at which the humidity reaches a predetermined level varies depending on the initial food temperature, thereby causing the taste and the quality of food to deteriorate.

That is, in the case of low initial food temperature, the food is cooked for a very long period, because the first heating time T1 is longer than that in a normal condition. Thus, the second heating time is lengthened. As a result, some nutritive elements in the food may be destroyed or the food may be burnt, thereby displeasing the taster's palate. On the other hand, when the initial food temperature is high, the time taken for cooking is short, thereby causing the food to be undercooked. Consequently, there is a disadvantage in that the taste of food can not be fully developed.

U.S. Pat. Nos. 4,311,895, 4,316,068 and 4,379,964 teach utilization a gas sensor for cooking control based on a concentration of gas.

SUMMARY OF THE INVENTION

Therefore, an object of the present invention is to provide an automatic cooking method in which food can be cooked for the optimum cooking period, irrespective of the initial food temperature.

A further object of the present invention is to provide an automatic cooking method wherein the quantity or concentration of gas or smoke occurring in a cooking chamber according to a lapse of time is determined and the cooking is performed for a period depending on the time taken for the quantity of gas or smoke to vary from a predetermined minimum value to a predetermined maximum value.

In accordance with the present invention having these objects, when a user depresses a cooking start key, food begins to be heated. During the heating process, the quantity of gas or smoke emitted from the food is determined every sampling time of a certain period so that the time T1 taken for the gas or smoke to vary from a predetermined minimum value to a predetermined maximum value is counted, as shown in FIG. 2. Thereafter, cooking is carried out by further heating the food for the time T2 corresponding to the product of the counted time T1 by the coefficient predetermined according to the food.

In order to accomplish the above-mentioned objects, the present invention provides an automatic cooking method having the steps of: setting an initialization operation upon applying electric power and preselecting a cooking mode according to data received from a keyboard equipped in a cooker; reading the gas or smoke from a gas or smoke sensor every sampling time, when the cooking mode is automatic cooking mode and setting a first heating time with the time taken for the gas or smoke to vary from a predetermined minimum value to a predetermined maximum value; calculating a second heating time by multiplying the first heating time by certain parameters and then heating for the second heating time.

BRIEF DESCRIPTION OF THE DRAWINGS

Other objects and aspects of the invention will become apparent from the following description of embodiments with reference to the accompanying drawings in which.

DETAILED DESCRIPTION OF THE INVENTION

Figure 1:
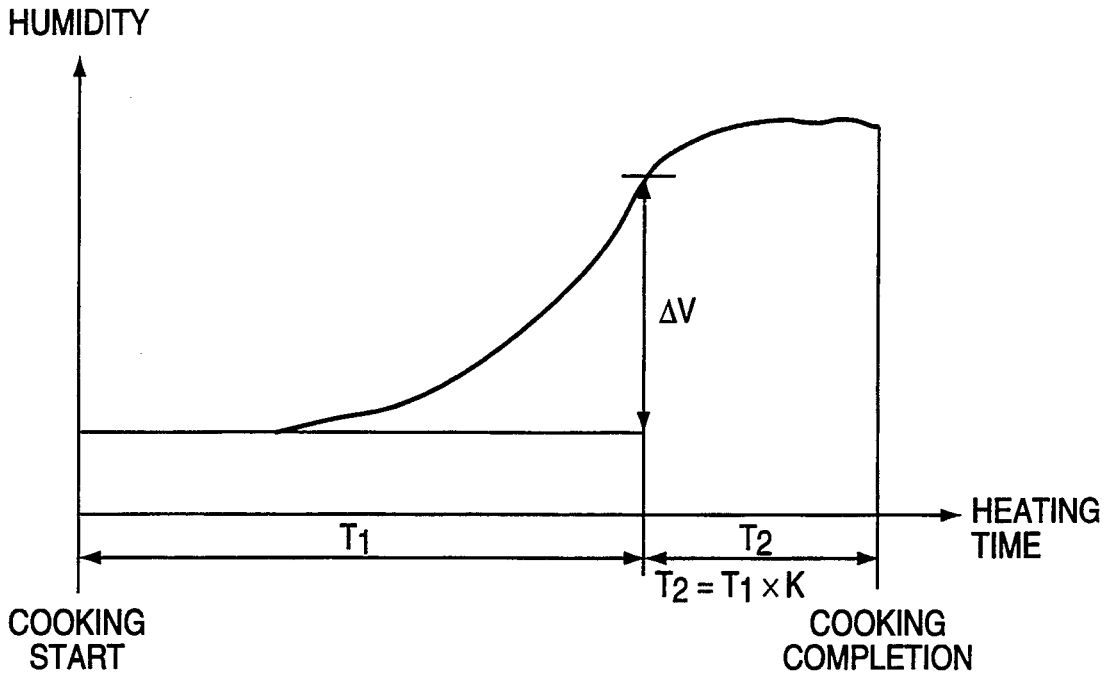
FIG. 1 is a graph showing the relationship between the gas or smoke and the heating time in accordance with a conventional automatic cooking method.
Figure 2:
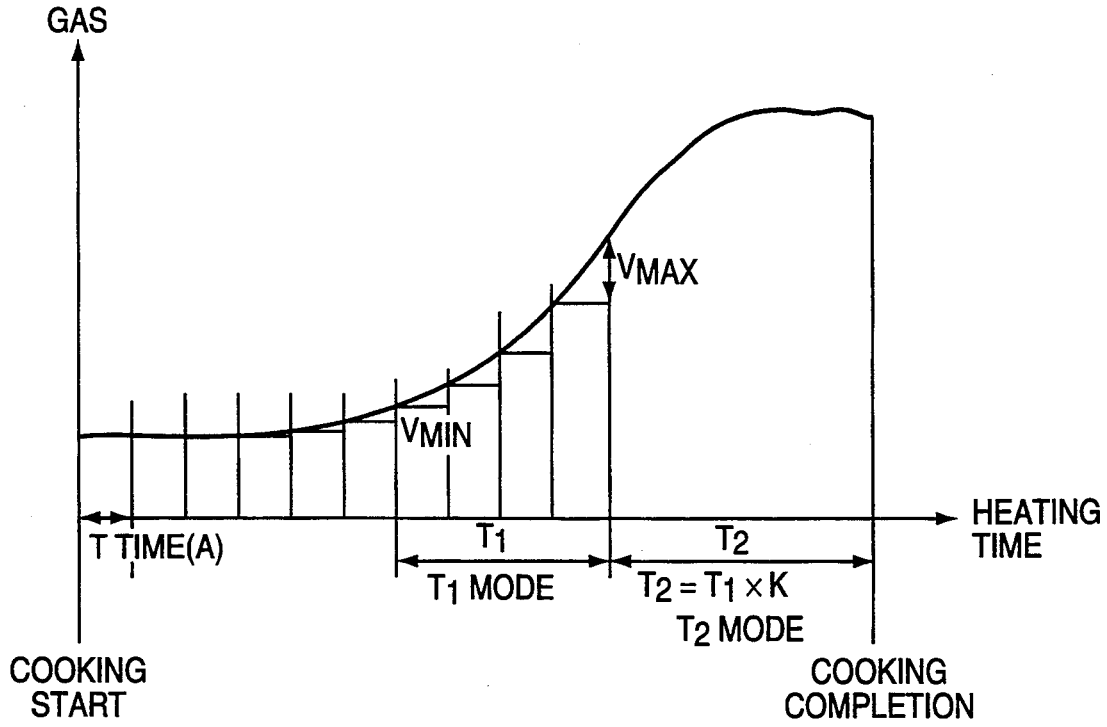
FIG. 2 is a graph showing the relationship between the gas or smoke and the heating time in accordance with an automatic cooking method of the present invention.

FIG. 1 graphically illustrates the relationship between the gas or smoke and the heating time in accordance with a conventional automatic cooking method.

Figure 3:
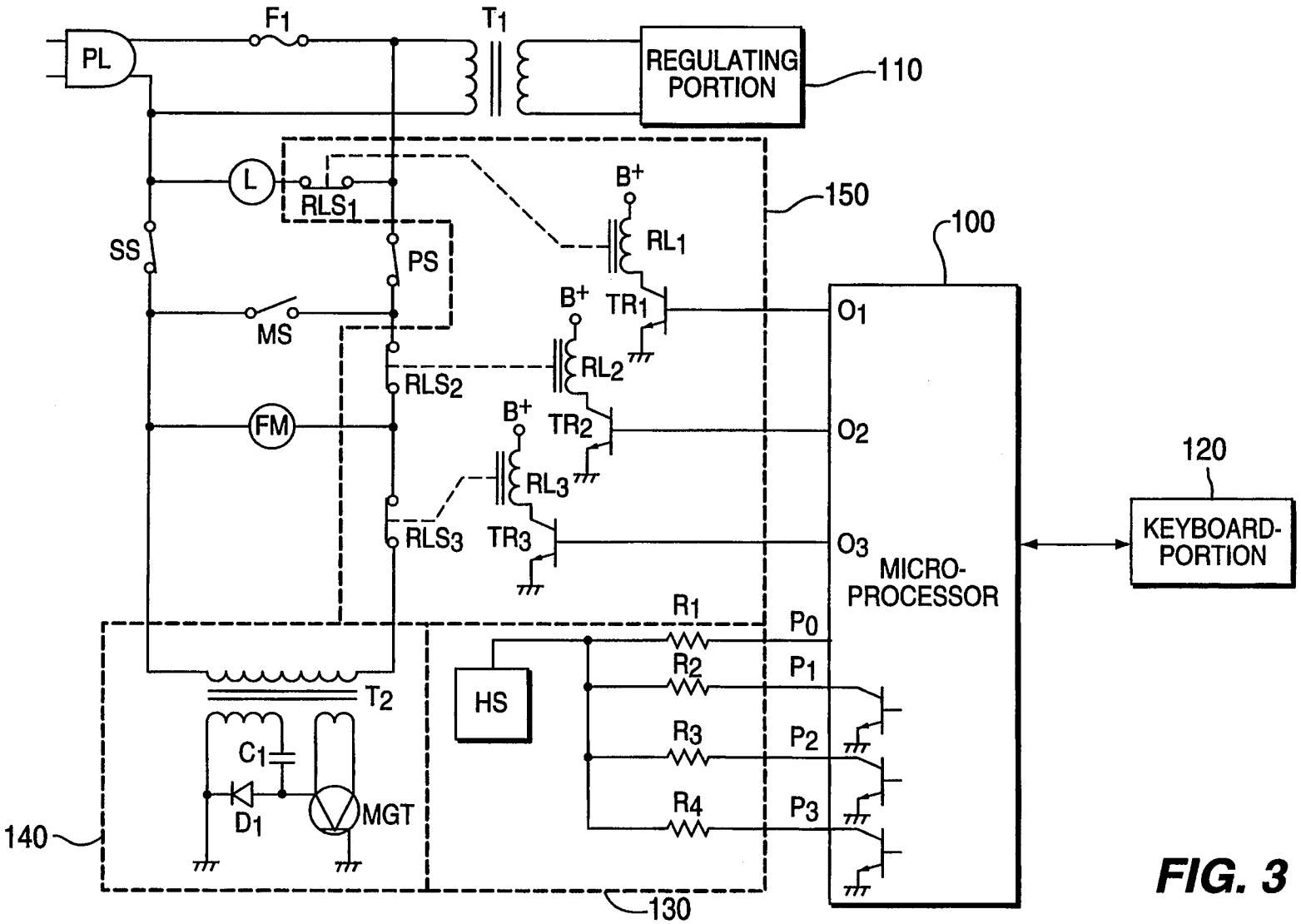
FIG. 3 is a circuit diagram showing a control circuit in an electronic range to which a gas or smoke sensor is utilized.

FIG. 3 illustrates a control circuit in an electronic range to which the present invention is applied.

As shown in the figure, the control circuit has a transformer TRANS1 adapted for dropping and inducing AC voltage regulator unit 110 adapted for converting the induced voltage into a constant voltage so as to supply actuating power to respective units of the circuit, a microprocessor 100 adapted for controlling overall cooking operations according to programs contained therein, a keyboard unit 120 adapted for supplying various operation commands to the microprocessor 100, and a gas or smoke sensor unit 130 provided with a gas or smoke sensor and resistors R1 to R4 and adapted for detecting the quantity of gas or smoke emitted from the food during cooking the food and supplying the detected value to the microprocessor 100.

The control circuit also has a primary safety switch PS, a secondary safety switch SS, a monitor switch MS, all of the switches being actuated according to the opening and closing of the door of the oven, a lamp L enabling the cooking state to be monitored, a fan motor FM, and a high voltage generator unit 140*a* which includes a high voltage transformer TRANS2 generating high-frequency wave output for cooking the food, a condenser C1, a diode D1, and a magnetron MGT.

The control circuit further has a drive control unit 150 adapted for controlling relays for supplying AC power to drive the lamp L, the fan motor FM and the high voltage generator unit 140 and including transistors TR1 to TR3, relays RL1 to RL3 and relay switches RLS1 to RLS3.

Figure 4A:
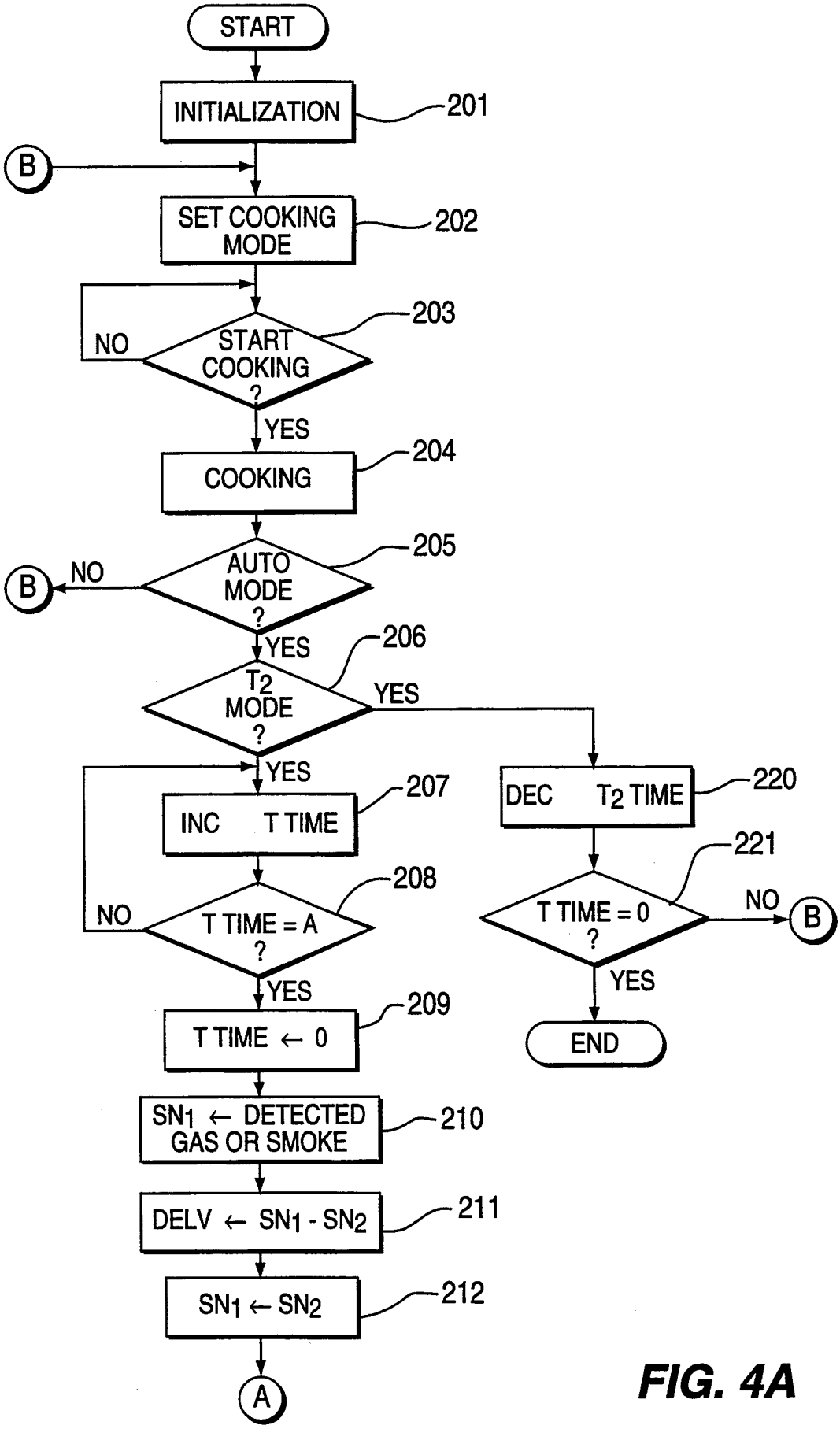
FIGS. 4A and 4B illustrate a flow chart showing the automatic cooking method of the present invention.
Figure 4B:
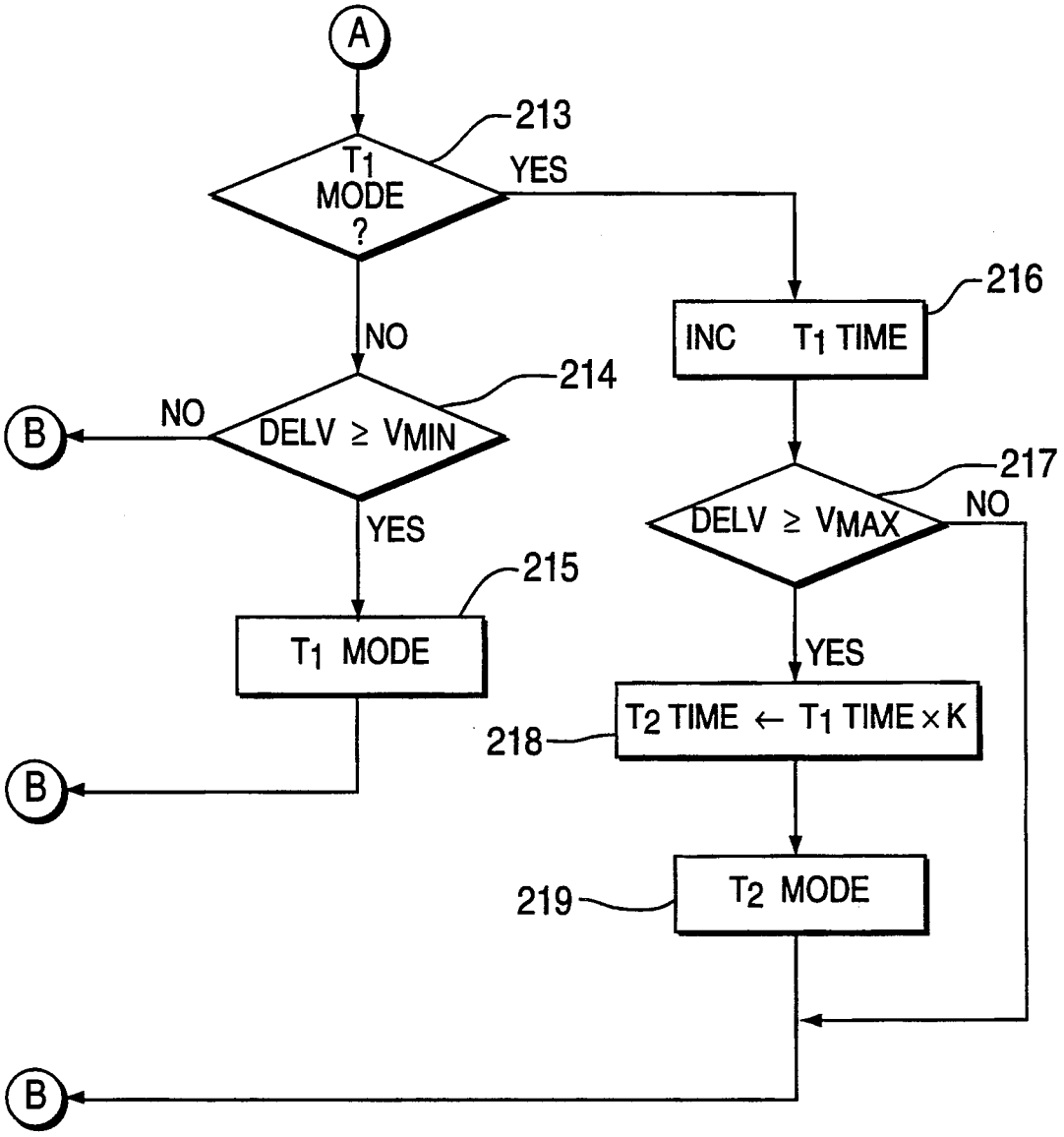

FIGS. 4A and 4B illustrate a flow chart showing the automatic cooking operations in the electronic range in accordance with the present invention. As shown in the figure, an initialization operation is performed at step 201. At step 202, the cooking mode is set to an automatic cooking mode or a timed cooking mode. It is determined at step 203 whether the cooking start key is depressed and then whether cooking of food should begin. If cooking should not begin, step 203 is repeatedly executed. In starting the cooking, the microprocessor 100 outputs signals at respective output ports 02 and 03 thereof, which signals actuate the relay switches RLS2 and RLS3, respectively. Thereby, the magnetron MGT is actuated for carrying out the cooking of food. Thereafter, it is determined at step 205 whether the cooking mode is an automatic cooking mode.

If the cooking mode is not the automatic cooking mode, the procedure returns to the cooking mode preselecting step 202. At the automatic cooking mode, it is determined at step 206 whether the cooking mode is the second heating mode, that is T2 mode. If the cooking mode is not the second heating mode (T2 mode), the sampling time buffer value TTIME is increased at step 207.

At step 208, it is determined whether the sampling time buffer value is a predetermined sampling time A. If the buffer value is no more than the predetermined sampling time A, step 207 is executed again. When the buffer value is the same as the predetermined sampling time A, the sampling time buffer TTIME is reset at step 209.

At step 210, the gas or smoke is detected and the detected value is stored in a first sensing buffer SN1. At this time, the gas or smoke sensor HS disposed in an exhaust duct and senses the quantity of gas or smoke generated as the food is heated. The sensing signal is received in the microprocessor 100, via the resistor R1 of the gas or smoke sensor unit 130.

The resistors R2 to R4 connected to the resistor R1 in parallel are adapted to operate the gas or smoke sensor HS within a certain range of gas or smoke. When the initial value of the gas or smoke sensor HS varies due to the fact that fumes, vapor and/or oil particles in the air are passing through the exhaust duct and adhere to the gas or smoke sensor after a long time use, the variation can be compensated by the resistors R2 to R4. The microprocessor 100 selects the resistors R2 to R4 so that the initial voltage of the gas or smoke sensor HS is within a predetermined range. The sensing signal from the gas or smoke sensor HS is adjusted to have a voltage of a predetermined range, according to the value provided by the parallel connection of the resistors R1 to R4 and then applied to the terminal PO of the microprocessor 100.

From the value stored in the first sensing buffer SN1, the value of the second sensing buffer SN2, in which the previously detected gas or smoke amount is stored, is subtracted at step 211. The calculated gas or smoke variation amount is stored in the variation amount buffer DELV. At step 212, the value of the first sensing buffer SN1 is stored in the second sensing buffer SN2. Thereafter, it is determined at step 213 whether the cooking mode is the first heating mode (T1 mode). If the cooking mode is not the first cooking mode (T1 mode), it is determined at step 214 whether the value stored in the variation buffer DELV is not less than the predetermined minimum variation amount Vmin. If the gas or smoke variation amount is not less than the predetermined minimum variation amount Vmin, the microprocessor 100 is set to operate in the first heating mode (T1 mode), at step 215. The minimum variation amount corresponds to the temperature of food in a range of 50° C. to 60° C. and is preprogrammed into the microcomputer and stored in variation amount buffer DELV.

In entering the first heating mode (T1 mode), the first heating time buffer value T1TIME is increased, at step 216. It is determined at step 217 whether the gas or smoke variation amount stored in the variation amount buffer DELV is not less than the predetermined variation amount Vmax. When the gas or smoke variation amount is not less than the predetermined variation amount Vmax, the time stored in the first heating time buffer T1TIME is multiplied by the coefficient K predetermined variably depending on the kind of the food, amount of food, cooking mode and the type of cooker used to heat the food at step 218. The product, that is the calculated time, is set as the second heating time buffer T2TIME. At step 219, the microprocessor is set to operate in the second heating mode (T2 mode).

In entering the second heating mode (T2 mode), the second heating time buffer value T2TIME is decreased, at step 220. Then, it is determined at step 221 whether the heating time buffer value T2TIME is 0. When the heating time buffer value T2TIME is 0, the microprocessor 100 outputs low level signals at its output ports 02 and 03. By the signals, the transistors TR2 and TR3 are switched into their OFF states, respectively, thereby causing the relay RL2 and RL3 to stop their driving. Accordingly, the relay switches RLS2 and RLS3 are switched into their OFF states, so that power supply to the high-frequency wave generator 140 is shut off. Thus, the cooking is completed.

As apparent from the above description, the present invention provides an automatic cooking method of determining a first heating time T1 taken for the gas or smoke detected in cooking to vary from a predetermined minimum value to a predetermined maximum value and secondarily heating the food for a time calculated by multiplying the first heating time by predetermined coefficients, so that the food can be heated for a cooking time properly predetermined for the food, irrespective of the initial heating condition. Accordingly, it is possible to bring out the taste of food well. Also, the loss of nutritive elements in the food may be greatly reduced, thereby enabling the cooking of food increasing the eater's appetite.

What is claimed is:

1. A method for automatically cooking food in a cooker comprising a cooking chamber, an exhaust duct discharging gas generated in said cooking chamber and a gas sensor disposed in said exhaust duct, the method comprising the steps of:

setting an initialization operation upon applying electric power to the cooker and preselecting a cooking mode according to data received from a keyboard equipped in the cooker, detecting a quantity of said gas sensed by said gas sensor every predetermined sampling time and storing said quantity in a microprocessor as a quantity value, when said cooking mode is in an automatic cooking mode;

determining a quantity value difference between the quantity value of a current sampling time and the quantity value of a sampling time immediately preceding said current sampling time;

determining whether said quantity value difference is less than a predetermined minimum value and cooking in a first heating mode when said quantity value difference is not less than said predetermined minimum value;

determining whether said quantity value difference is less than a predetermined maximum value and cooking in said first heating mode until said quantity value difference is not less than said predetermined maximum value;

detecting time taken for said quantity value difference to vary from said predetermined minimum value to said predetermined maximum value;

setting a first heating time period to equal the time taken for the quantity value difference to vary from said predetermined minimum value to said predetermined maximum value;

calculating a second heating time period by multiplying said first heating time period by a predetermined coefficient determined by certain parameters; and cooking in a second heating mode for said second heating time period.

2. The method in accordance with claim 1, wherein said parameters are determined depending on the amount of food, the cooking mode, and the kind of cooker used to heat the food.

3. The method in accordance with claim 1, wherein said predetermined maximum value of the quantity value difference is set in dependence upon a program providing a plurality of values corresponding to a plurality of kinds of the foodstuffs.

4. The method in accordance with claim 1, wherein said predetermined minimum value of the quantity value difference corresponds to the temperature of food in a range of 50° C. to 60° C.

5. A method for automatically cooking food in a cooker comprising, a keyboard, a cooking chamber, an exhaust duct discharging gas generated in said cooking chamber and a gas sensor disposed in said exhaust duct, the method comprising the steps of:

setting an initialization operation upon applying electric power to the cooker;

preselecting a cooking mode according to data received from said keyboard;

determining whether the cooking mode is a second heating mode, when said cooking mode is an automatic cooking mode;

when the cooking mode is determined as the second heating mode, decreasing a time value stored in a second heating mode time buffer;

when the time value stored in the second heating mode time buffer is equal to zero, ending the cooking;

when the second heating mode time buffer value is not equal to zero, returning the procedure to the cooking mode preselecting step;

when the cooking mode is not the second heating mode, increasing a sampling time buffer value and when the sampling time buffer value is not equal to a predetermined value, repeating said increasing of the sampling time buffer value;

when the sampling time buffer value equals the predetermined value, receiving a concentration value indicative of a quality of said gas sensed by the gas sensor and storing the concentration value in a first buffer corresponding to a current sampling time, determining a difference value between the concentration value stored in the first buffer and a concentration value stored in a second buffer corresponding to a sampling time immediately preceding said current sampling time, storing the difference value in a variation amount buffer, and changing the concentration value in the second buffer to the current concentration value;

determining whether the cooking mode is a first heating mode;

increasing a time value in a first heating mode time buffer when the cooking mode has been determined to be the first heating mode, and determining whether the difference value is less than a maximum difference value;

repeating said preselecting of the cooking mode when the difference value is less than the maximum difference value;

generating a product by multiplying the time value in the first heating mode time buffer by a factor K and storing the product in the second heating mode time buffer when the difference value is not less than the maximum difference value, setting the cooking mode to the second heating mode, and repeating said preselecting of the cooking mode;

when the cooking mode has not been determined to be the first heating mode in said step of determining whether the cooking mode is a first heating mode, determining whether the difference value is less than a minimum difference value;

when the difference value is less than the minimum difference value returning the procedure to the cooking mode preselecting step;

when the difference value is not less than the minimum difference value, setting the cooking mode to the first heating mode and repeating said preselecting of the cooking mode.

6. The method as claimed in claim 5, wherein said minimum difference value corresponds to when food temperature reaches a range between 50° C. and 60° C. during said automatic cooking mode.

7. A method for automatically cooking food in a cooker comprising a keyboard, a cooking chamber, an exhaust duct discharging smoke generated in said cooking chamber and a smoke sensor disposed in said exhaust duct, the method comprising the steps of:

setting an initialization operation upon applying electric power to the cooker and preselecting a cooking mode according to data received from said keyboard;

detecting a quantity of said smoke sensed by said smoke sensor every predetermined sampling time and storing said quantity in a microprocessor as a quantity value, when said cooking mode is in an automatic cooking mode;

determining a quantity value difference between the quantity value of a current sampling time and the quantity value of a sampling time immediately preceding said current sampling time;

determining whether said quantity value difference is less than a predetermined minimum value and cooking in a first heating mode when said quantity value difference is not less than said predetermined minimum value;

determining whether said quantity value difference is less than a predetermined maximum value and cooking in said first heating mode until said quantity value difference is not less than said predetermined maximum value;

detecting time taken for said quantity value difference to vary from said predetermined minimum value to said predetermined maximum value;

setting a first heating time period to equal the time taken for the quantity value difference to vary from said predetermined minimum value to said predetermined maximum value;

calculating a second heating time period by multiplying said first heating time period by a predetermined coefficient determined by certain parameters; and cooking in a second heating mode for second heating time period.

8. The method in accordance with claim 7, wherein said parameters are determined depending on the amount of food, the cooking mode, and the kind of cooker used to heat the food.

9. The method in accordance with claim 7, wherein said predetermined maximum value of the quantity value difference is set in dependence upon a program providing a plurality of values corresponding to a plurality of kinds of the foodstuffs.

10. The method in accordance with claim 7, wherein said predetermined minimum value of the quantity value difference corresponds to the temperature of food in a range of 50° C. to 60° C.

11. A method for automatically cooking food in a cooker comprising, a keyboard, a cooking chamber, an exhaust duct discharging smoke generated in said cooking chamber and a smoke sensor disposed in said exhaust duct, the method comprising the steps of:

setting an initialization operation upon applying electric power to the cooker;

preselecting a cooking mode according to data received from said keyboard;

determining whether the cooking mode is a second heating mode, when said cooking mode is an automatic cooking mode;

when the cooking mode is determined as the second heating mode, decreasing a time value stored in a second heating mode time buffer;

ending the cooking mode when the time value stored in the second heating mode time buffer is equal to 0;

repeating said preselecting of the cooking mode when the second heating mode time buffer value is not equal to zero;

when the cooking mode is not the second heating mode, increasing a sampling time buffer value;

when the sampling buffer value does not equal a predetermined value, repeating the procedure of increasing the sampling time buffer value;

when the sampling time buffer value equals the predetermined value, receiving a concentration value indicative of a quantity of said gas sensed by the smoke sensor and storing the received concentration value in a first buffer corresponding to a current sampling time, determining a difference value between the concentration value stored in the first buffer and a concentration value stored in a second buffer corresponding to a sampling time immediately preceding said current sampling time, storing the difference value in a variation amount buffer, and changing the concentration value in the second buffer to the current concentration value;

determining whether the cooking mode is a first heating mode;

increasing a time value in a first heating mode time buffer when the cooking mode has been determined to be the first heating mode, and determining whether the difference value is less than a maximum difference value;

repeating said preselecting of the cooking mode when the difference value is less than the maximum difference value generating a product by multiplying the time value in the first heating mode time buffer by a factor K an storing the product in the second heating mode time buffer when the difference value is not less than the maximum difference value, setting the cooking mode to the second heating mode, and repeating said preselecting of the cooking mode preselecting step;

when the cooking mode has not been determined to be the first heating mode in said step of determining whether the cooking mode is a first heating mode, determining whether the difference value is less than a minimum difference value;

when the difference value is less than the minimum difference value returning the procedure to the cooking mode preselecting step when the difference value is not less than the minimum difference value, setting the cooking mode to the first heating mode and repeating said preselecting of the cooking mode.

12. The method as claimed in claim 11, wherein said minimum difference value corresponds to when food temperature reaches a range between 50° C. and 60° C. during said automatic cooking mode.

13. A method for automatically cooking food in a cooker comprising a keyboard, a cooking chamber, an exhaust duct discharging carbon dioxide generated in said cooking chamber and a carbon dioxide sensor disposed in said exhaust duct, the method comprising the steps of:

setting an initialization operation upon applying electric power to the cooker and preselecting a cooking mode according to data received from said keyboard;

detecting said quantity of said carbon dioxide by said carbon dioxide senor every predetermined sampling time and storing said quantity in a microprocessor as a quantity value, when said cooking mode is in an automatic cooking mode;

determining a quantity value difference between the quantity value of a current sampling time and the quantity value of a sampling time immediately preceding said current sampling time;

determining whether said quantity value difference is less than a predetermined minimum value and cooking in a first heating mode when said quantity value difference is not less than said predetermined minimum value;

determining whether said quantity value difference is less than a predetermined maximum value and cooking in said first heating mode until said quantity value difference is not less than said predetermined maximum value;

detecting time taken for said quantity value difference to vary from said predetermined minimum value to said predetermined maximum value;

setting a first heating time period equal to the time taken for the quantity value difference to vary from said predetermined minimum value to said predetermined maximum value;

calculating a second heating time period by multiplying said first heating time period by a predetermined coefficient determined by certain parameters; and cooking in a second heating mode for said second heating time period.

14. The method in accordance with claim 13, wherein said parameters are determined depending on the amount of food, the cooking mode, and the kind of cooker used to heat the food.

15. The method in accordance with claim 13, wherein said predetermined maximum value of the quantity value difference is set dependent upon a program written corresponding to kinds of the foodstuffs.

16. The method in accordance with claim 13, wherein said predetermined minimum value of the quantity value difference corresponds to the temperature of food in a range of 50° C. to 60° C.

17. A method for automatically cooking food in a cooker which includes a cooking chamber, an exhaust duct discharging carbon dioxide generated in said cooking chamber and a carbon dioxide sensor disposed in said exhaust duct, the method comprising the steps of:

setting an initialization operation upon applying electric power to the cooker;

preselecting a cooking mode according to data received from a keyboard equipped in the cooker;

determining whether the cooking mode is a second heating mode, when said cooking mode is an automatic cooking mode;

when the cooking mode is determined as the second heating mode, decreasing a time value stored in a second heating mode time buffer and when the time value stored in the second heating mode time buffer is equal to 0, ending the cooking;

when the second heating mode time buffer value is not equal to 0, returning the procedure to the cooking mode preselecting step;

when the cooking mode is not the second heating mode, increasing a sampling time buffer value and when the sampling buffer value does not equal to a predetermined value, repeating the procedure of increasing the sampling time buffer value;

when the sampling time buffer value equals the predetermined value thus corresponding to a desired sampling time, receiving a concentration value from the carbon dioxide sensor and storing the received concentration value in a first buffer corresponding to a current sampling time, determining a difference value between the concentration value stored in the first buffer and a concentration value stored in a second buffer corresponding to a sampling time immediately preceding said current sampling time and storing the difference value in a variation amount buffer and changing the concentration value in the second buffer to the current concentration value;

determining whether the cooking mode is a first heating mode;

increasing a time value in a first heating mode time buffer when the cooking mode has been determined to be the first heating mode in the previous step, and determining whether the difference value is less than a maximum difference value;

returning the procedure to the cooking mode preselecting step when the difference value is less than the maximum difference value;

multiplying the time value in the first heating mode time buffer by a certain factor K and storing the product in the second heating mode time buffer when the difference value is not less than the maximum difference value, setting the cooking mode to the second heating mode, and returning the procedure to the cooking mode preselecting step;

when the cooking mode has not been determined to be the first heating mode in said step of determining whether the cooking mode is a first heating mode, determining whether the difference value is less than a minimum difference value when the difference value is lees than the minimum difference value, returning the procedure to the cooking mode preselecting step;

when the difference value is not less than the minimum difference value, setting the cooking mode to the first heating mode and returning the procedure to the cooking mode preselecting step.

18. The method as claimed in claim 17, wherein said minimum difference value corresponds to when food temperature reaches a range between 50° C. and 60° C. during said automatic cooking mode.

* * * * *

UNITED STATES PATENT AND TRADEMARK OFFICE

CERTIFICATE OF CORRECTION

PATENT NO. : 5,349,163
DATED : September 20, 1994
INVENTOR(S) : Seong-Wan An

It is certified that error appears in the above-indentified patent and that said Letters Patent is hereby corrected as shown below:

IN THE CLAIMS

| | | |
|---|---|---|
| Column 5, | Line 44, | After "cooker", Change comma "," to semicolon --;-- ; |
| Column 7, | Line 61, | Preceding "second", Insert --said-- ; |
| Column 8, | Line 58, | After "K", Change "an" to --and-- ; |
| Column 10, | Line 57, | Change "lees" to --less-- . |

Signed and Sealed this

Twenty-first Day of February, 1995

*Attest:*

Bruce Lehman

BRUCE LEHMAN

*Attesting Officer*

*Commissioner of Patents and Trademarks*